US006575698B2

(12) United States Patent
Beeck et al.

(10) Patent No.: US 6,575,698 B2
(45) Date of Patent: Jun. 10, 2003

(54) SEALING OF A THERMAL TURBOMACHINE

(75) Inventors: Alexander Beeck, Kuessaberg (DE); Ulrich Rathmann, Baden (CH); Hans E. Wettstein, Fislisbach (CH)

(73) Assignee: Alstom (Switzerland) Ltd, Baden (CH)

( * ) Notice: Subject to any disclaimer, the term of this patent is extended or adjusted under 35 U.S.C. 154(b) by 6 days.

(21) Appl. No.: 09/897,477

(22) Filed: Jul. 3, 2001

(65) Prior Publication Data

US 2002/0015641 A1 Feb. 7, 2002

(30) Foreign Application Priority Data

Aug. 7, 2000 (DE) ..... 100 38 452

(51) Int. Cl.[7] ..... F01D 11/08

(52) U.S. Cl. ..... 415/173.4; 415/173.5; 415/174.4; 415/174.5

(58) Field of Search ..... 415/173.1, 173.4, 415/174.4, 173.5, 174.5; 277/414

(56) References Cited

U.S. PATENT DOCUMENTS 4,346,904 A * 8/1982 Watkins, Jr. ..... 277/414
4,618,152 A * 10/1986 Campbell ..... 277/414
4,623,298 A * 11/1986 Hallinger et al. ..... 415/139
4,832,999 A * 5/1989 Sweet ..... 428/116
5,096,376 A * 3/1992 Mason et al. ..... 415/173.5
5,520,508 A 5/1996 Khalid

FOREIGN PATENT DOCUMENTS

DE 3335570 A1 7/1984

* cited by examiner

*Primary Examiner*—Ninh Nguyen
(74) *Attorney, Agent, or Firm*—Burns, Doane, Swecker & Mathis, L.L.P.

(57) ABSTRACT

A honeycomb structure is arranged on a stator of a gas turbine and is arranged opposite the moving blades of the gas turbine. The honeycomb structure is composed of metal sheets in such a way that webs having double the sheet thickness are obtained and connections of single thickness are obtained between the webs. The angle α between the circumferential direction of the stator and the webs of double thickness is 5° to 175°. This serves to avoid undesirable efforts such as, for example, overheating during friction at the honeycomb structure of the moving blades of the gas turbine.

6 Claims, 1 Drawing Sheet

SEALING OF A THERMAL TURBOMACHINE

FIELD OF THE INVENTION

Figure 1:
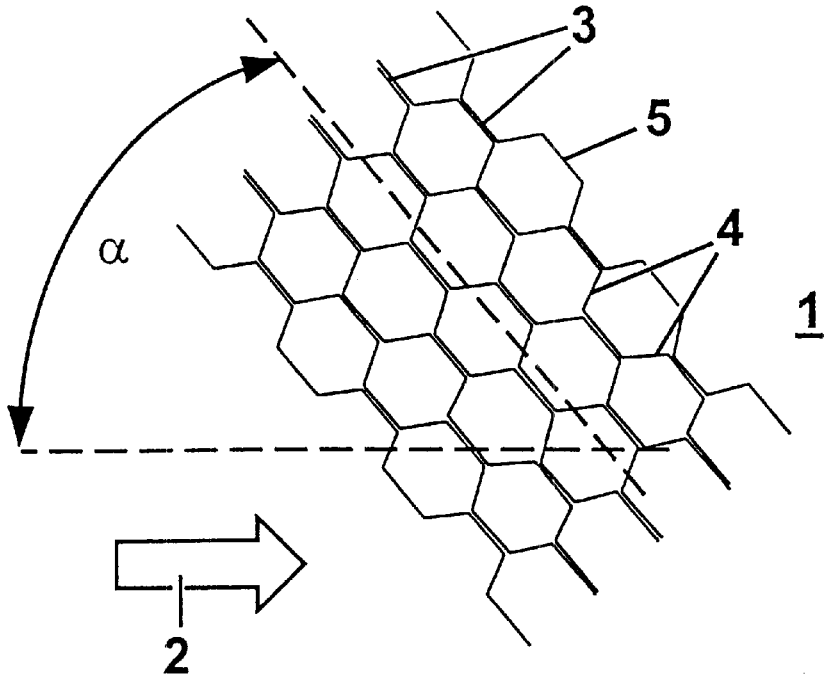

The invention deals with the sealing of a thermal turbomachine.

The invention deals with the sealing of a thermal turbomachine according to the preamble of claim 1.

BACKGROUND OF THE INVENTION

The guide and moving blades of gas turbines are subjected to high loads. In order to keep down the leakage losses of the gas turbine, the moving blade of the gas turbine is fitted relative to the stator in such a way that grazing occurs. A honeycomb structure is attached to the stator of the gas turbine in a position opposite the moving blade. The moving blades work themselves into this structure, so that a minimum sealing gap occurs between the moving blades and the honeycomb structure. The honeycomb structure consists of a heat-resistant metal alloy. It is composed of a plurality of sheet-metal strips which are bent in accordance with the subsequent shape. This construction of the honeycombs results in double-walled webs and connections of single thickness between the webs.

It is known from the prior art to arrange the double-walled webs of the honeycomb structure in the circumferential direction of the stator. However, this does not have very advantageous effects on the frictional behavior of the moving blades. Thus excessive heating may occur if the blade tip covers a plurality of honeycombs and therefore rubs continuously on the double configurations.

SUMMARY OF THE INVENTION

The aim of the invention is to overcome these disadvantages. The invention achieves the object of improving the frictional behavior between the moving blades and the honeycomb structure and of reducing the undesirable secondary effects of the friction, such as, for example, heating of the components involved.

According to the invention, the aim is achieved in a honeycomb structure in that the angle between the circumferential direction of the stator and the webs of double thickness is 5° to 175°.

In order to achieve the same aim, the sheet thickness of the individual sheets at the points at which the sheets on the honeycomb structure form the webs may advantageously be reduced relative to the sheet thickness of the connections.

In a further embodiment, the length of the webs may be reduced in relation to the length of the connections, so that a deformed honeycomb is obtained. The ratio of the length of the webs to the length of the connections between the webs of the deformed honeycomb may be 1:1 to at most 1:20. The effect can additionally be assisted if the angle between a web and the two adjacent connections varies between 60° and 120°.

BRIEF DESCRIPTION OF THE DRAWING FIGURES

Figure 2:
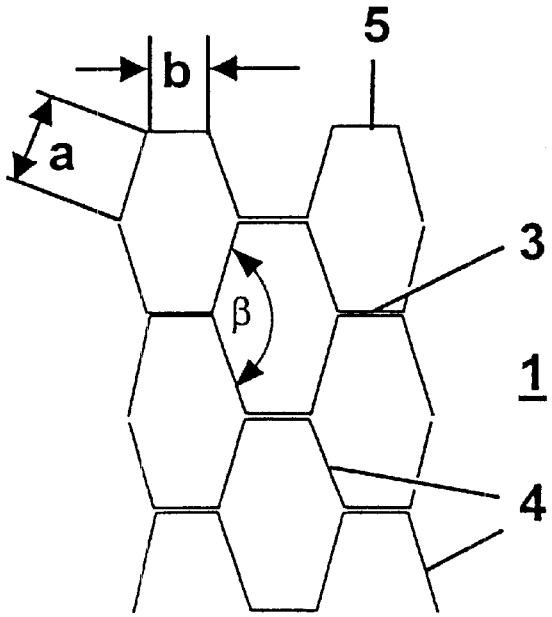

Preferred embodiments of the invention are disclosed in the following description and illustrated in the accompanying drawings, in which:

FIG. 1 shows a first embodiment of an arrangement according to the invention of a honeycomb structure, and FIG. 2 shows a second embodiment of a honeycomb structure according to the invention.

Only the elements essential for the invention are shown. The same elements are provided with the same reference numerals in different figures.

The invention relates to a sealing system between the moving blades and the stator of a gas turbine. A honeycomb structure 1 in FIG. 1, which is fastened to the stator (not shown), consists of individual metal sheets 5 of a heat-resistant alloy. The sheets 5 are formed in such a way that they form hexagonal honeycombs. In this case, the sheets 5 are fastened to one another at webs 3, so that the structure 1 is of double-walled design at these points. There are connections 4 of single thickness between the webs 3.

According to the invention, the honeycomb structure 1 is attached to the stator in such a way that there is an angle $\alpha$ of 5° to 175° between the axis which forms the webs 3 and a circumferential direction 2 of the stator or the moving blades of the gas turbine.

The frictional behavior of the moving blades at the honeycomb structure 1 can be improved by this arrangement, since, in particular, overheating of the affected parts is limited by avoiding permanent friction at the double-walled webs 3.

In a further embodiment, the sheet thickness of the individual sheets 5 at the points at which the sheets 5 on the honeycomb structure 1 form the webs 3 may be reduced relative to the sheet thickness of the connections 4. This also improves the frictional behavior between the moving blades and the honeycomb structure 1.

In a second embodiment, which likewise improves the frictional behavior and is shown in FIG. 2, the honeycomb is "deformed". In this case, the length b of the webs 3 with respect to the length a of the connections 4 may be in a ratio of 1:1 to at most 1:20. The effect may additionally be assisted if the angle $\beta$ between a web 3 and the two adjacent connections 4 varies between 60° and 120°.

What is claimed is:

1. A honeycomb structure which is arranged on a stator of a thermal turbomachine and which is arranged opposite the moving blades of the thermal turbomachine, the honeycomb structure being composed of metal sheets in such a way that webs having double a thickness of the sheets are obtained and connections of single thickness are obtained between the webs, wherein an angle between a circumferential direction of the stator and the webs of double thickness is 5° to 175° and a ratio between a length of the webs to a length of the connections between the webs of the honeycomb is above 1:1 and up to 1:20.

2. The honeycomb structure as claimed in claim 1, wherein the sheet thickness of the individual sheets at the points at which the sheets on the honeycomb structure form the webs is reduced relative to the sheet thickness of the connections.

3. The honeycomb structure as claimed in claim 1, wherein the thermal turbomachine is a gas turbine.

4. A structure arranged on a stator of a thermal turbomachine, comprising:

a plurality of metal sheets formed as a honeycomb, said adjacent metal sheets being fastened to one another by webs of double sheet thickness and by webs of single sheet thickness, longitudinal axes of said webs of double sheet thickness being parallel to each other;

wherein an angle between a circumferential direction of the stator and the webs of double thickness is 5° to 175° and angles between two adjacent webs of single sheet thickness vary between 60° and below 120°.

5. The structure of claim 4, wherein the sheet thickness of the individual sheets at the points at which the sheets on the honeycomb structure form the webs is reduced relative to the sheet thickness of the connections.

6. The structure of claim 4, wherein the thermal turbomachine is a gas turbine.

* * * * *